United States Patent [19]

Boley

[11] 4,039,107

[45] Aug. 2, 1977

[54] ROLLER ENTRY GUIDE HAVING IMPROVED GUIDE INSERT AND ROLLER ADJUSTMENT MEANS

[76] Inventor: Robert E. Boley, Main and Canal Sts., Brinkhaven, Ohio 43006

[21] Appl. No.: 630,982

[22] Filed: Nov. 12, 1975

[51] Int. Cl.[2] ..... G03B 1/56

[52] U.S. Cl. ..... 226/91; 226/181; 226/199; 308/3 A

[58] Field of Search ..... 226/91, 181, 196, 199; 308/3 R, 3 A

[56] References Cited

U.S. PATENT DOCUMENTS

| | | | |
|---|---|---|---|
| 3,430,832 | 3/1969 | Meyer | 226/196 |
| 3,675,837 | 7/1972 | Gerould | 226/181 |

*Primary Examiner*—Joseph F. Peters, Jr.
*Assistant Examiner*—Richard A. Bertsch
*Attorney, Agent, or Firm*—Reese Taylor

[57] ABSTRACT

An improved insert for a roller entry guide box for use with steel mills and in particular steel rod mills is disclosed wherein a replaceable machined guide insert is provided to guide stock into the working mill rolls, insuring accurate centering of the same, whereby the insert can be readily changed when it becomes worn so as to insure continued accuracy and precision with a minimum of cost. The insert is a cylindrical member which is insertable into the guide box cavity adjacent the discharge end thereof and cooperates with a static guide member to form a continuous channel for reception of the stock. The insert has a funnel-shaped interior bore which serves to guide the stock onto the desired center line so that it passes along a center line between the guide rolls, which then feed the stock into the working rolls. Unique adjustment means are also provided to control the spacing of the guide rolls relatively of the center line.

9 Claims, 10 Drawing Figures

ROLLER ENTRY GUIDE HAVING IMPROVED GUIDE INSERT AND ROLLER ADJUSTMENT MEANS

BACKGROUND OF THE INVENTION

This invention, in general, relates to steel mills and, in particular, steel rod mills wherein a continuous forging operation is performed and has particular relevance to an improvement to the roller entry guide box apparatus utilized in connection with feeding stock into the working mill rolls.

DESCRIPTION OF THE PRIOR ART

The known prior art generally consists of a variety of designs of roller entry guides used in guide boxes, all of which, however, employ matching static guide leaves which are forged or cast and have a funnel-shaped interior passageway which enables the rod or other stock to be guided, once it enters the box, to the center line for passing through the guide rollers and on into the mill rolls.

However, it is important that the stock material be aligned as accurately as possible for entry into the mill rolls, and in this regard the spacing between the guide rolls which ultimately feed the material into the working mill rolls can be held within thousandths. However, the casting of the conventional static guide leaves, which are not machined pieces, is such that they can be off as much as a sixteenth of an inch or more. The result of this imprecision in the static guide leaves is that the rod will strike the guide rolls off center, forcing the guide rolls themselves to serve as a centering means, and thereby causing undue wear on the rolls which are relatively expensive. Also, when the guide leaves, and particularly the area adjacent the discharge end thereof, become worn or otherwise damaged, the entire leaf assembly must be replaced which is also expensive since they are of such a size as to span the distance between the intake and discharge ends of the guide box itself.

A still further feature of the known prior art is the means for adjusting the guide rolls themselves with respect to the center line. While the existing prior art permits accurate adjustment of the guide rolls, this adjustment is normally accomplished by means of set screws received on the side of the housing and intended to permit adjustment of the rollers relative to the center line. The difficulty with this type of arrangement is twofold. First of all, the rolls are not held very securely due to the fact that the set screws are in point contact with the leaves of the rollers; and secondly, any adjustment which is possible has to be achieved from the side of the housing. This is disadvantageous since the roller entry guide itself is often arranged in a series arrangement wherein two or more strands of wire or stock material are fed into the mill rolls. When this is done, the sides of the housing are not accessible; and therefore, the entire bank of guides must be disassembled to make any adjustment in the roller disposition.

SUMMARY OF THE INVENTION

It has been discovered that some of the above-noted disadvantages can be obviated by providing a first relatively short machined insert which fits into the cavity in the guide box adjacent the discharge end thereof or, in other words, the end adjacent the guide rollers. It has been discovered that this insert can be machined and held to appropriately close tolerances so as to insure that the rod of stock will be accurately aligned with the center line of the guide rolls, thereby avoiding undue wear thereon.

Furthermore, since the improved insert is a relatively small piece when compared with the overall static guide of the prior art, it is relatively economical to replace it when it becomes worn, thereby avoiding the necessity of replacing the relatively large part which comprises the static guide itself.

It has also been found that adjustment of the guide rolls relatively to the center line can be improved by pivotally mounting the leaves which carry the rolls to the opposed side of the housing of the guide box itself and providing cam means which are accessible from the top of the housing. The cam means include inclined cam surfaces on the leaves and cam wedges. This permits not only ready adjustment even when the guide box is arranged in a series arrangement, but also improves the security of the adjustment once it has been obtained due to the fact that the cam wedges provide a line-type contact rather than the point-type contact achieved with the set screws of the prior art.

Accordingly, production of an improved insert for a roller entry guide box of the character described becomes the principal object of this invention, with other objects thereof becoming more apparent upon a reading of the following brief specification, considered and interpreted in view of the accompanying drawings.

OF THE DRAWINGS

BRIEF DESCRIPTION OF THE PREFERRED EMBODIMENT

Figure 1:
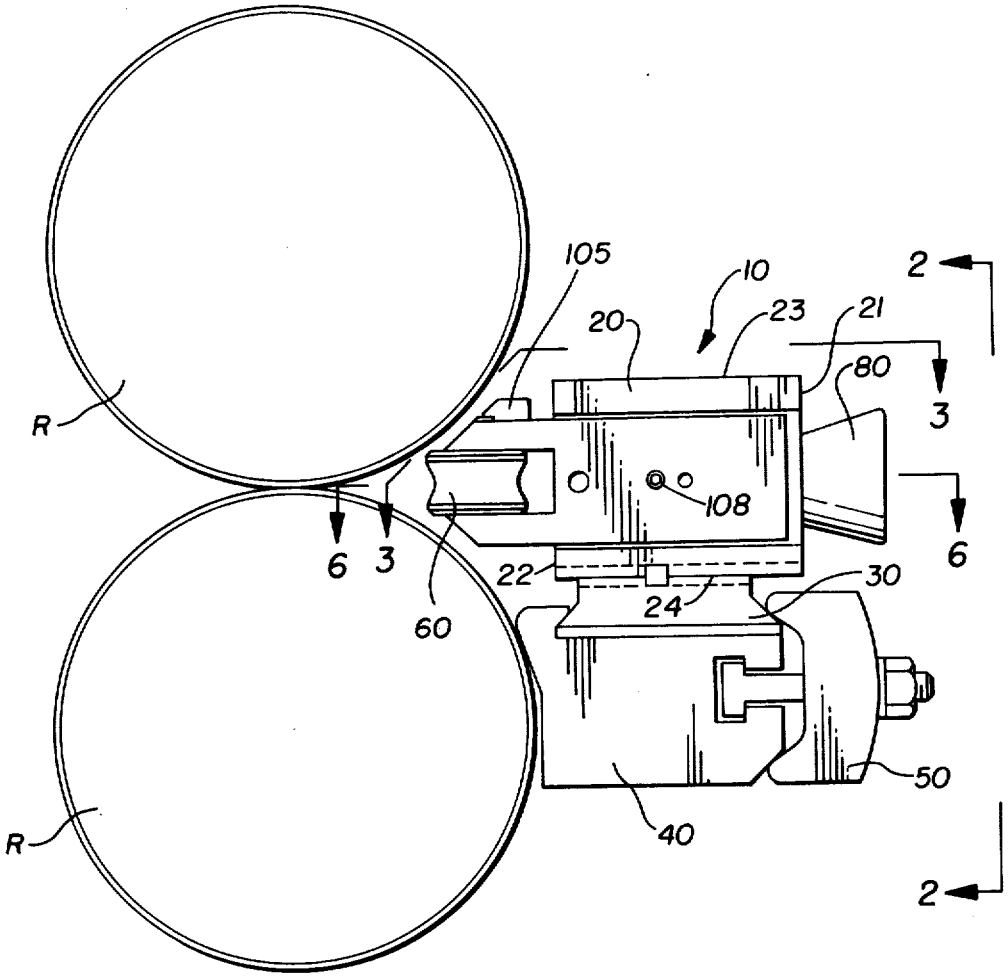
FIG. 1 is an elevational view showing the improved assembly installed adjacent the mill rolls.
Figure 2:
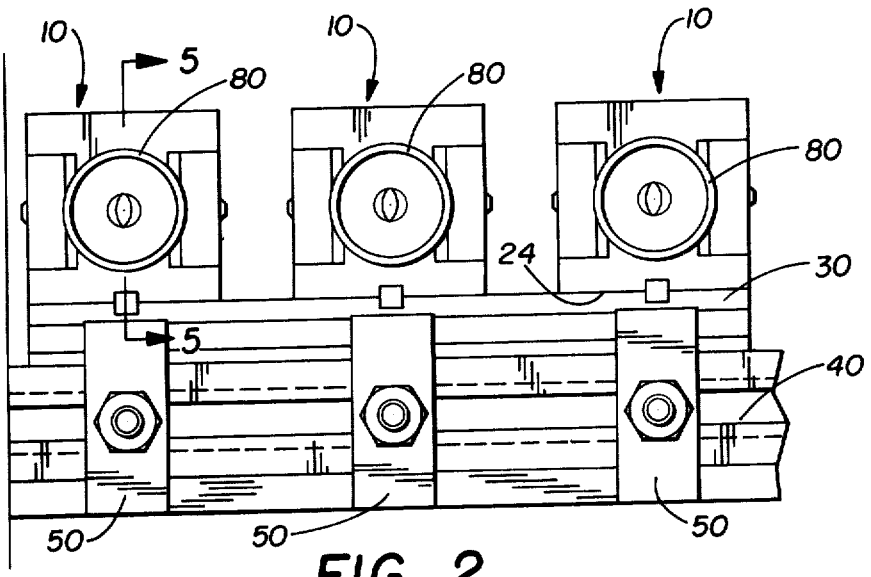
FIG. 2 is a front view showing a multiplicity of assembled guide boxes embodying the present invention taken along the line 2—2 of FIG. 1.

Referring first to FIG. 1 of the drawings, it will be noted that the improved guide box assembly, generally indicated by the numeral 10, includes a guide box housing 20, an adapter plate 30, rest bar 40, and clamp 50.

Figure 5:
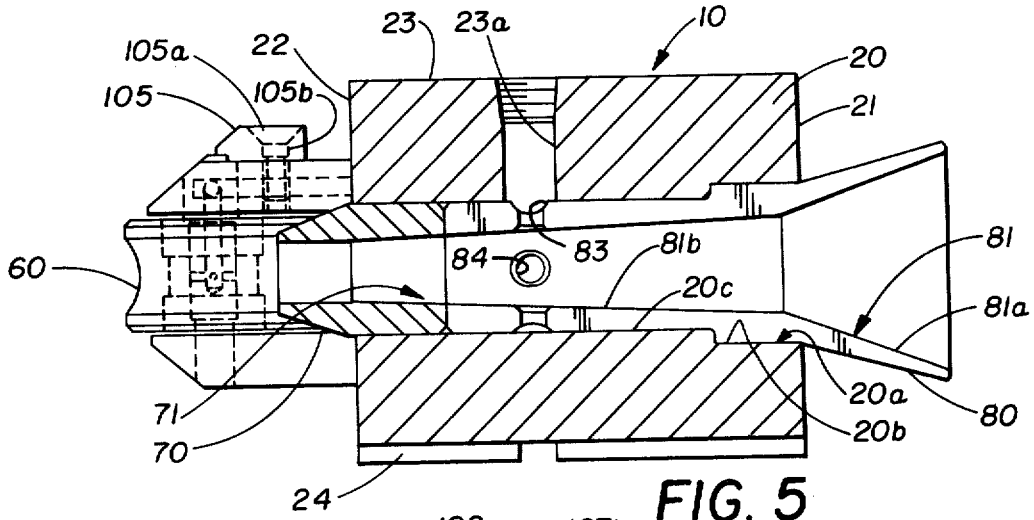
FIG. 5 is a sectional view of the insert taken along the line 5—5 of FIG. 2.
Figure 6:
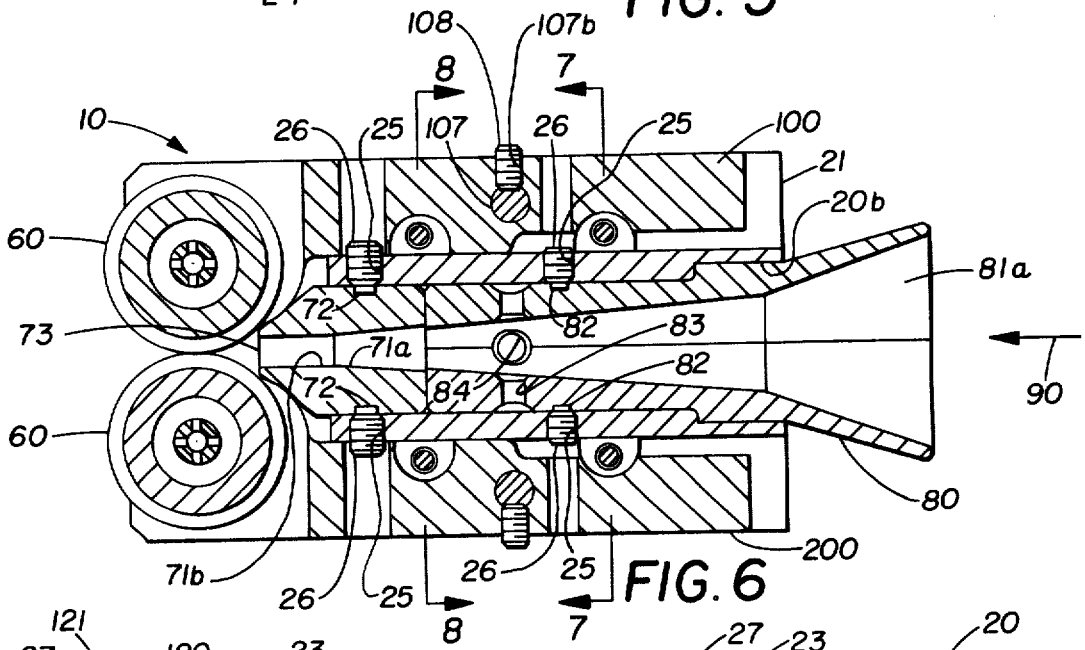
FIG. 6 is a horizontal sectional view taken along the line 6—6 of FIG. 1.

Referring also to FIGS. 5 and 6, it will be noted that the body or housing of the guide box 20 includes an intake end 21 and a discharge end 22. Opening into the intake end 21 is a through central bore **20*a* which includes a first bore 20*b* and a counterbore 20*c*** of reduced diameter for reception of the guide insert which will be described in greater detail below.

The housing 20 also includes a through aperature **23*a* in its top surface 23 communicating with the central bore 20*a* for coolant supply purposes. Also included in the opposed side walls of the housing 20 are tapped and threaded bores 25,25 which receive set screws 26,26** to hold the insert in place, as will also be described more fully below.

The bottom of the housing 24 has a key machined thereon so that the same can be slid into the keyway of adapter plate 30 as shown in FIG. 1. Adapter plate 30 is then held in rest bar 40 by means of the clamp 50, as also shown in FIG. 1.

Turning again then to FIGS. 5 and 6 for a more detailed description of the insert assembly, it will be noted that a first insert 70 is provided and is a relatively short member having an external diameter substantially the same as the internal diameter of the through bore 20*c* of the housing 20. The first guide insert 70 has a through central bore generally indicated by the numeral 71. This bore is generally funnel-shaped from one end, as generally indicated by the numeral 71*a,* tapering to a minimum diameter adjacent the second portion of the bore 71*b.* Overall, the bore 71 is illustrated as being generally oval shaped to accommodate an oval configuration on the stock. However, the invention is not intended to be so limited, and the internal configuration could be varied depending upon the type of stock being run.

It will be noted that there are oppositely disposed recesses 72,72 in the side walls of the first insert 70, and as will be clearly shown in FIG. 6 of the drawings, the insert can be slipped into the through bore 20*a* of the housing 20 and secured in place by the set screws 26,26 which are threaded into the body and have their ends received in the recesses 72,72. In this way rotation is prevented, and the first insert 70 is securely, yet easily releasably, mounted interiorly of the housing.

The second guide insert 80 is made in two halves, but when assembled, assumes a generally cylindrical configuration having a through central bore generally indicated by the numeral 81. This through bore tapers from the funnel-shaped configuration 81*a* adjacent the intake end 21 of the housing 20 to a tapering configuration as indicated at 81*b,* with this portion narrowing toward the point of engagement between the first guide insert 70 and the second guide insert 80. Opposed recesses 82,82 are also received in the side walls of the second insert 80 for receipt of set screws 26,26 which are threaded into the apertures 25,25 of the housing 20. In this way the second insert 80, having an external configuration comparable to the internal configuration of the bore 20*a* of the housing, can be slipped into place, following which the set screws 26,26 can be tightened. In this fashion the second insert 80 is securely held in place and yet is readily releasable if it has to be removed from the housing 20. An annular groove 83 is also provided about the periphery of the second insert 80, and when the insert 80 is in place within the housing, this groove will be in alignment with the aperture 23*a* so that coolant can be provided through the aperture 23*a* about the groove 83 and into the interior of the insert through aperture 84.

Accordingly, it will be seen that by utilization of the unique two-piece guide inserts 70 and 80, the first guide insert can be machined and held to very close tolerances so that the stock, which will be entering the intake end in the direction of the arrow 90, can be directed very accurately along the center line, thereby minimizing damage to the rolls 60,60. Since the first insert 70 will take most of the punishment and wear, it, being relatively short, can easily be removed and replaced without the necessity of replacing the larger course-adjustment type second insert 80, which can simply be cast and requires no machining operation since it is used to make a relatively rough alignment of the stock.

Turning next then to a description of the leaves for mounting the rollers, it will be noted from FIG. 6 that a pair of roller leaves 100,200 are mounted on opposed sides of the housing 20. For purposes of description, only the roller leaf 100 will be described in detail, with it being understood that the leaf 200 is identical but in opposite hand relation.

Figure 4:
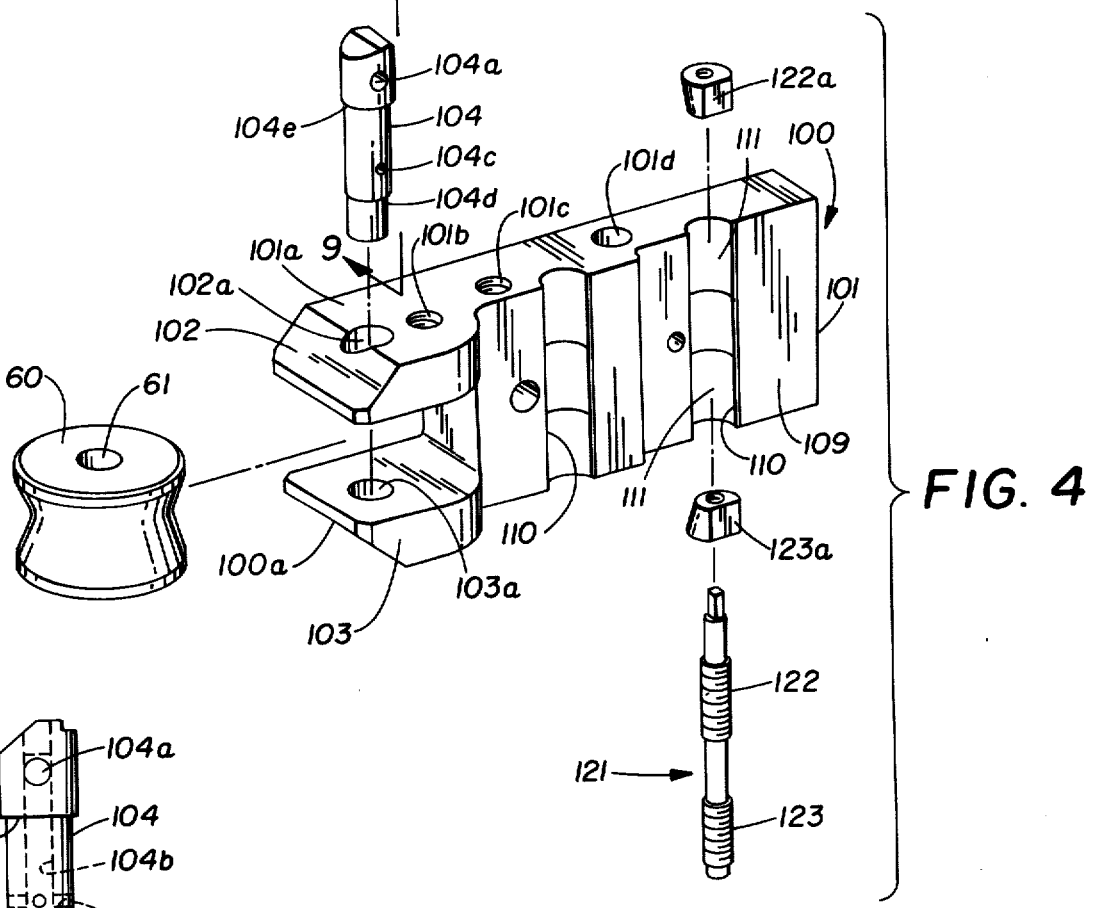
FIG. 4 is an exploded perspective view showing the roller leaf assembly and the camming means.
Figure 9:
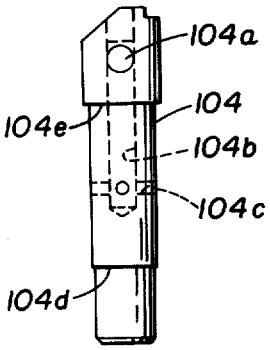
FIG. 9 is an elevational view of the roller shaft.
Figure 10:
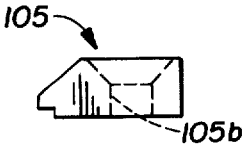
FIG. 10 is an elevational view of the roller shaft retainer.

Accordingly then and referring particularly to FIG. 4, it will be noted that the leaf 100 is elongate and has a first end 101 and a second end 100*a.* The end 100*a* is bifurcated, having a top leg 102 and a bottom leg 103. These legs have through bores 102*a* and 103*a* which are in axial alignment with each other. The roller 60 is intended to be received between the legs 102 and 103 and held in place by the roller shaft 104.

As will be seen from FIGS. 4 through 9, roller shaft 104 is an elongated member having an inlet port 104*a* which communicates with a central bore 104*b,* which in turn communicates with a plurality of radially extending openings 104*c,* 104*c.* In this fashion a spray mist can be forced through the opening 104*a,* through the central bore 104*b,* and directed on to the rollers through the apertures 104*c,* 104*c* for coolant and lubrication purposes.

Shaft 104 also has a shoulder 104*d* which will rest on the top of the bottom leg 103 and a shoulder 104*e* which will rest on the top of the top leg 102. In this way when the shaft 104 is in place through the central aperture 61 of the roller 60, it will be prevented from passing completely through the bore 102*a* and 103*a.*

Once the shaft 104 has been assembled with the roller 60, the assembly is held in place by a roller shaft retainer 105 which seats on the top surface 101*a* of the leaf 100 and is secured thereto by a screw 105*a,* which is received in counterbored aperture 105*b* in the shaft retainer and into a threaded aperture 101*b* in the top of the leaf. In this way the entire roller assembly is secured on the end of the leaf.

Also in the top surface 101*a* of the leaf 100 is a drilled and tapped bore 101*c* which is in communication with the through bore 105*b* which leads to the bore 104*b* in the roller shaft 104. In this way the lubrication for the roller can be forced through this interconnecting system of bores and on to the rollers themselves.

Figure 3:
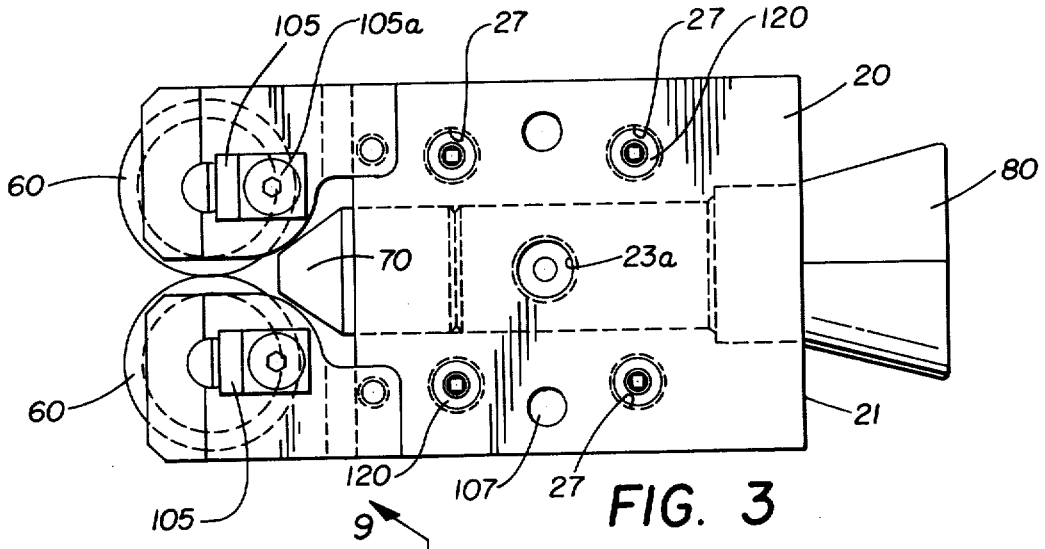
FIG. 3 is a top plan taken along the line 3—3 of FIG. 1 showing one of the guide box assemblies.

Also reamed into the top surface 101*a* of the leaf 100 is a through aperture 101*d.* A complemental hole is received in the housing 20, and a tapped hole 107*d* communicates with the side of the leaf. A pivot pin 107 is received within the aperture 101*d* and is held in place by the set screw 108. In this way the pivot pin 107 is locked to the leaf. The upper and lower ends of the pin are freely received in the upper and lower legs of the housing as shown, for example, in FIG. 3.

Figure 7:
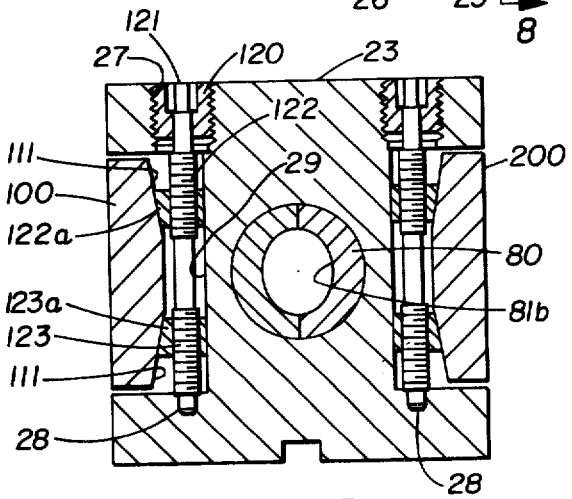
FIG. 7 is a sectional view taken along the line 7—7 of FIG. 6 showing part of the camming means.
Figure 8:
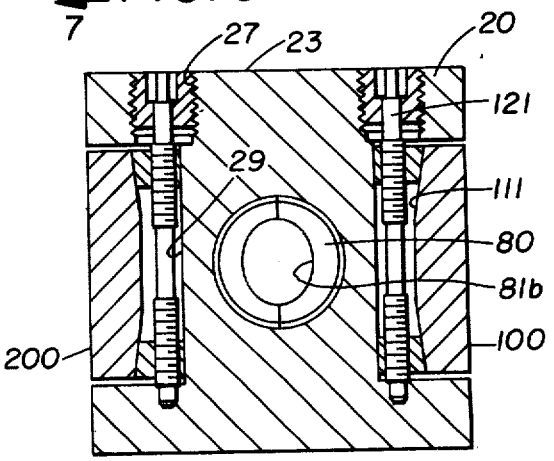
FIG. 8 is a sectional view taken along the line 8—8 of FIG. 6 and showing another part of the camming means.

In the face 109 of the leaf 100, a pair of spaced-apart semi-circular grooves are machined. In cross section the interior of these grooves 110,110 present oppositely inclined camming surfaces 111,111, as shown in FIGS. 7 and 8 for example.

The housing 20 has a plurality of drilled and tapped apertures 27,27 in its top surface and a plurality of holes 28,28 in axial alignment with the drilled and tapped holes 27,27. A bushing 120 is threaded into each of the drilled and tapped apertures 127,127, and the adjusting screw 121 is then received within the bushing. The adjusting screw 121 has a right-hand thread portion 122 and a left-hand thread portion 123. Associated with the threaded portions 122 and 123 are adjusting wedges 122a and 123a. As will be seen in FIGS. 7 and 8, these adjusting wedges have inclined surfaces which engage the inclined camming surfaces 111,111 of the leaf 100. The opposed edge surfaces of the adjusting wedges 123a,122a contact the side wall 29 of the housing 20.

Accordingly, in this fashion adjustment of the adjustment screw 121, which has a square head on it for engagement with a suitable wrench, will cause the adjustment wedges 122a, 123a to move along the camming surfaces 111,111 of the roller leaf. This will cause the leaf to pivot about the axis of the pivot pin 107, and depending upon the direction in which the adjustment screw 121 is turned, the rollers will be forced toward or away from the center line. In this manner the precise spacing between the rollers 60,60 with respect to the center line can be very accurately controlled, and it should be noted that the adjusting wedges 122a,123a are in line contact with the camming surfaces on the leaf and in line contact with the side of the housing so that once adjustment is achieved, an extremely secure lock can be maintained so as to assure that the precise adjustment desired is retained.

Furthermore, it should be noted in this instance that due to the fact that the adjusting screws 121,121 are accessible from the top of the housing 20, it is possible to perform the adjusting function regardless of the particular disposition of the overall roller guide box assembly with respect to the mill housing or adjacent guide box assemblies.

It will accordingly be seen that an improved roller entry guide having two distinct advantages has been achieved. First, by means of the two-piece insert assembly, it is possible to machine the first insert 70 to very close tolerances so as to insure precise accuracy adjacent the discharge end and adjacent the rollers. On the other hand, it is not necessary to machine the second insert 80 which provides a more or less course adjustment or alignment feature. Furthermore, while the machined surface will be subject to great wear, the fact that it is a relatively small portion of the overall assembly and also is readily removable minimizes the normal difficulties encountered.

It should be noted that while the guide insert assembly has been described and illustrated as part of an overall roller entry guide assembly, the same could be utilized as an adapter for a conventional roller guide assembly.

It has also been shown how improved adjustment means have been provided for the rollers whereby the same can be adjusted with respect to the center line, notwithstanding the fact that the overall roller entry guide assembly may be disposed in a bank of assemblies thereby prohibiting access to the sides thereof for adjustment purposes.

Additionally, the improved adjustment means provide a much more secure lock once adjustment has been achieved due to the fact that the adjusting wedges and the cam surfaces provide a line-type of contact, thereby increasing the area of contact and assuring that once adjustment is achieved, it will be maintained.

While a full and complete description of the invention has been set forth in accordance with the dictates of the Patent Statutes, it should be understood that modifications thereof can be resorted to without departing from the spirit hereof or the scope of the appended claims.

What is claimed is:

1. A roller entry guide, comprising;
- A. a housing having
  - 1. an intake end and a discharge end and
  - 2. a through central bore communicating said intake and discharge ends;
- B. a pair of guide rolls
  - 1. externally mounted on said housing adjacent said discharge end,
  - 2. and spaced from the center line of said through central bore of said housing;
- C. a first guide insert
  - 1. secured to said housing within said through central bore thereof adjacent said discharge end,
  - 2. with one end thereof partially projecting beyond said discharge end in close proximity with said guide rolls,
  - 3. having a through central passageway disposed coaxially with said through central bore of said housing;
- D. a second guide insert
  - 1. secured to said housing within said through central bore thereof,
  - 2. with one end thereof in abuttment with the non-projecting end of said first guide insert and
  - 3. the remaining end thereof projecting beyond the intake end of said housing and
  - 4. having a through central passageway in communication with said passageway of said first guide insert.

2. The roller entry guide of claim 1 further characterized by the presence of
- A. means for selectively adjusting the spacing of said guide rolls
  - 1. carried by said housing and
  - 2. being accessible from the top of said housing.

3. The roller entry guide of claim 1 wherein said first guide insert has a length dimension substantially less than the length dimension of said through central bore of said housing and the length dimension of said second guide insert.

4. The roller entry guide of claim 3 wherein said first guide insert is characterized by
- A. a generally cylindrical body having first and second ends;
- B. said through central passageway having
  - 1. a funnel-shaped configuration extending inwardly from said first end, and
  - 2. an oval-shaped configuration extending from the end of said funnel-shaped configuration to said second end of said body.

5. The roller entry guide of claim 4 further characterized by the presence of locking means carried by said housing and said body of said first guide insert whereby said first guide insert may be releasably secured to said housing.

6. A guide insert assembly for use with a roller entry guide box having intake and discharge ends, guide rolls carried externally of the box adjacent the discharge end and a through central bore interconnecting said ends, comprising;
- A. a first guide insert
  - 1. releasably attachable to said guide box within said central bore adjacent said end,
  - 2. with one end projecting beyond said discharge end in close proximity with said guide rolls; and
- B. a second guide insert
  - 1. releasably attachable to said guide box within said central bore adjacent said intake end, 2. with one end engaging the non-projecting end of said first guide insert and the remaining end projecting beyond said intake end.

7. A roller entry guide, comprising;

A. a housing having
1. an intake end and a discharge end and
2. a through central bore communicating said intake and discharge ends;

B. a guide insert assembly
1. releasably secured to said housing within said through central bore and
2. having a through central passageway disposed coaxially with said through central bore of said housing;

C. adjustable support means carried by opposed sides of said housing;

D. a pair of guide rolls
1. attached to said support means adjacent said discharge end
2. and spaced from the center line of said through central bore of said housing; and E. adjustment means carried by said housing and said support means and accessible from the top of said housing for moving said guide rolls relatively of the center line of said through central bore of said housing.

8. A roller entry guide, comprising;

A. a housing having
1. an intake end and a discharge end and
2. a through central bore communicating said intake and discharge ends;

B. a pair of guide rolls
1. mounted on said housing adjacent said discharge end,
2. and spaced from the center line of said through central bore of said housing;

C. a first guide insert
1. secured to said housing within said through central bore thereof adjacent said discharge end,
2. with one end thereof partially projecting beyond said discharge end,
3. having a through central passageway disposed coaxially with said through central bore of said housing;

D. a second guide insert
1. secured to said housing within said through central bore thereof,
2. with one end thereof in engagement with the non-projecting end of said first guide insert and
3. the remaining end thereof projecting beyond the intake end of said housing and
4. having a through central passageway in communication with said passageway of said first guide insert;

E. means for adjusting the spacing of said guide rolls
1. carried by said housing and
2. being accessible from the top of said housing; and F. said adjustment means including
1. a pair of elongate roller leaves pivotally mounted on opposed sides of said housing; and
2. cam means interconnecting said roller leaves to said housing for camming engagement between said leaves and said housing.

9. The roller entry guide of claim 8 wherein said cam means include

A. inclined camming surfaces on each of said roller leaves;

B. a plurality of cam wedges contacting said camming surfaces and the side of said housing; and C. means for moving said cam wedges along said camming surfaces.

* * * * *